US006084609A

United States Patent [19]

Manini et al.

[11] Patent Number: 6,084,609

[45] Date of Patent: Jul. 4, 2000

[54] INK-JET PRINT HEAD WITH MULTIPLE NOZZLES PER EXPULSION CHAMBER

[75] Inventors: Enrico Manini, Chiaverano; Franco Fabbri, Pavone; Pier Luigi Soriani, Ivrea, all of Italy

[73] Assignee: Olivetti-Lexikon S.p.A., Ivrea, Italy

[21] Appl. No.: 08/643,404

[22] Filed: May 6, 1996

Related U.S. Application Data

[63] Continuation of application No. 08/251,235, May 31, 1994, abandoned.

[30] Foreign Application Priority Data

May 31, 1993 [IT] Italy ..... TO93A0371

[51] Int. Cl.[7] ..... B41J 2/145; B41J 2/155

[52] U.S. Cl. ..... 347/40; 347/42; 347/47; 347/54

[58] Field of Search ..... 347/40, 42, 43, 347/47, 54

[56] References Cited

U.S. PATENT DOCUMENTS

| | | | |
|---|---|---|---|
| 4,007,464 | 2/1977 | Bassous et al. | 347/47 |
| 4,131,899 | 12/1978 | Christou | 347/71 |
| 4,169,008 | 9/1979 | Kurth | 347/47 |
| 4,353,079 | 10/1982 | Kawanabe | 347/15 |
| 4,357,614 | 11/1982 | Tamai | 347/47 |
| 4,396,924 | 8/1983 | Rosenstock | 347/68 |
| 4,542,389 | 9/1985 | Allen | 346/140 R |
| 4,550,326 | 10/1985 | Allen et al. | 346/140 R |
| 4,611,219 | 9/1986 | Sugitani et al. | 346/140 R |
| 4,829,319 | 5/1989 | Chan | 347/47 |
| 5,168,283 | 12/1992 | Hammond et al. | 347/130 |
| 5,305,015 | 4/1994 | Schantz et al. | 347/47 |
| 5,325,118 | 6/1994 | Zybin et al. | 347/47 |
| 5,327,166 | 7/1994 | Shimada | 347/183 |

FOREIGN PATENT DOCUMENTS

| | | | |
|---|---|---|---|
| 030382 | 6/1981 | European Pat. Off. . | |
| 225169 | 6/1987 | European Pat. Off. . | |
| 352978 | 1/1990 | European Pat. Off. . | |
| 471157 | 2/1992 | European Pat. Off. . | |
| 500110 | 8/1992 | European Pat. Off. . | |
| 406047914 | 2/1994 | Japan | 347/47 |

OTHER PUBLICATIONS

Patent Abstracts of Japan, JP61268453, vol. 11, No. 125 (M–582).

Patent Abstracts of Japan, JP2194961, vol. 14, No. 481 (M–1037).

*Primary Examiner*—Benjamin R. Fuller
*Assistant Examiner*—Craig A. Hallacher
*Attorney, Agent, or Firm*—Banner & Witcoff, Ltd.

[57] ABSTRACT

An ink-jet print head (12) for a dot printer, in which the drops of ink are expelled from one or more expulsion chambers (16) through corresponding pluralities of nozzles (30), each plurality communicating with each individual chamber. The nozzles (30) communicating with each chamber may be three to nine in number and are suitably arranged so as to obtain a high print quality in particular for the printing of characters with straight edges free from irregularities.

11 Claims, 9 Drawing Sheets

INK-JET PRINT HEAD WITH MULTIPLE NOZZLES PER EXPULSION CHAMBER

This is a Continuation of application Ser. No. 08/251,235 filed May 31, 1994 now abandoned.

FIELD OF THE INVENTION

The present invention relates to an ink-jet print head of the type which comprises an expulsion chamber in communication with a plurality of nozzles for expelling corresponding droplets of ink and in which at least two of said nozzles are arranged in a row oriented in a reference direction.

BACKGROUND OF THE INVENTION

U.S. Pat. No. 4,611,219 discloses an ink-jet print head having at least one group of aligned expulsion chambers.

Each chamber contains a transducer for causing expulsion of the ink simultaneously from two nozzles.

All the nozzles are aligned in a single row in the direction of alignment of the chambers, forming a line of nozzles designed in particular to print an entire line at a time and hence obtain printing of a complete page with a single scanning movement.

A head of this type, with all the nozzles aligned in a single row, is able to print, whenever activated, at the most a continuous, but very thin line with a width equal to the dimension of each dot.

Therefore, in order to print characters or graphic symbols with a width much greater than the dimension of each dot, several passing movements are required, hence reducing the printing speed.

U.S. Pat. Nos. 4,542,389 and 4,550,326 disclose print heads of the type mentioned above, in which each expulsion chamber has associated with it several openings. Of these openings only one constitutes the active nozzle for expelling drops of ink, being arranged in the region of the heating resistor.

Additional openings communicating with the same pressure chamber are used in order to drain an excess of ink dispersed by the active nozzle or in order to neutralize reflex pressure pulses capable of influencing negatively the operation of active nozzles associated with other adjacent expulsion chambers.

These additional openings or orifices have a completely passive function since they do not expel drops of ink, not being associated with any heating resistor.

In a conventional ink-jet print head, for example of the type described in the U.S. Pat. No. 4,550,326 already referred to, the single active nozzle of a given expulsion chamber is normally dimensioned so as to expel drops of ink, the volume of which depends substantially on the energy supplied by the resistor and its dimensions.

Usually the active nozzle is constructed with a diameter more or less the same as the dimension of a side of the associated resistor which is generally square in shape, a dimension equal, for example, to about 40 to 60 $\mu$m in the case of a printing resolution of 300 dots per inch.

Therefore, when particularly dense information or very intense images must be printed with this head, for example on a sheet of paper, the large quantity of ink deposited on the paper through the nozzle requires a given amount of time in order to dry, a time which in many cases is too long compared to the printing speed of the head.

Moreover the characteristic restoration time for the meniscus of a large-size nozzle, as referred to above, is fairly long and such that it limits the expulsion frequency of the drops to fairly low values.

Furthermore it is true that, according to a first approximation and with all other parameters, such as for example the characteristics of the ink, being equal, the expulsion frequency depends inversely on the volume of the drops expelled.

However, if drops with a small volume, for example a volume less than 80–90 pl, are used, again in the case of a printing resolution of 300 dots per inch, there is a deterioration in the print parameters such as, for example, the optical density and the quality of the edges of graphic symbols.

This limitation penalizes considerably ink-jet heads, compared to other faster dot printing methods, for example laser printing.

Furthermore, this head also has the following drawbacks:

- unsatisfactory optical density, unless large quantities of ink are used to obtain intense colours;
- non-linear shades of grey, when there is a variation in the number of dots deposited;
- poor linearity of the edges of elongated impressions, for example the letters I, L, etc.

The optical density is considered unsatisfactory for the following reason: if a single nozzle is used, the impression of a drop of ink on the paper is substantially circular, so that the arrangement, next to one another, of several impressions which are mutually tangent and circular, i.e. with a diameter equal to the printing pitch, results, as is known, in a white zone, not covered by ink, inside each group of four adjacent impressions.

In order to eliminate these white zones, the impression of each dot must be widened by varying the moistness characteristics of the ink or by partially overlapping the impressions of contiguous dots.

In both cases a large quantity of ink must be deposited on the paper. As a result the drying time increases and the paper tends to warp.

Hence, an acceptable optical density can be obtained only at the expense of both the drying time, which becomes longer, and the flatness of the paper, which tends to become crinkled.

On the other hand, reducing the volume of ink expelled from the single nozzle of each chamber produces on the paper smaller dots separated by larger white zones, causing an even greater deterioration in the optical density.

In order to obtain uniform shades of grey, the optical density must be varied in direct proportion to the number of dots deposited for a given matrix. In practice if a single nozzle is used, the optical density increases in direct proportion to the number of dots deposited in the case of low coverage, for medium coverage (40–75%) it increases more rapidly than the number of dots deposited, while for high coverage it increases less rapidly than the increase in the dots deposited, on account of the random merging of a certain number of adjacent impressions. For example, if the number of dots deposited is increased from about 80% to 100%, from a visual inspection the optical density does not appear to increase.

Finally, the profile of the edge of elongated impressions, especially in the direction perpendicular to the movement of the head, for example in the case of characters l, k, etc., has the appearance of a succession of rounded arches, resulting in a poor print quality.

SUMMARY OF THE INVENTION

Preferred embodiments of the present invention, seek to provide an ink-jet print head which does not have the abovementioned drawbacks.

One aspect of an embodiment of the present invention provides an ink-jet print head which is able to expel simultaneously from each expulsion chamber, whenever activated, a plurality of drops of ink with a very high repetition frequency.

Another aspect of an embodiment of the present invention provides an ink-jet print head capable of depositing on a printing medium drops of ink with a very rapid drying time.

Another aspect of an embodiment of the present invention provides an ink-jet print head for printing with a given optical density using the minimum quantity of ink whatever the printing matrix used.

Yet another aspect of an embodiment of the invention is that of providing an ink-jet head for printing, on an information medium, dots having a form such that the optical density can be varied in direct proportion to a variation in the dots deposited.

Yet another aspect of an embodiment of the invention is that of providing a print head able to obtain impressions having an edge with a substantially straight profile, particularly suitable for printing bar codes or characters.

An ink-jet print head according to the present invention, is characterized in the manner illustrated in the claims to which reference should now be made.

These and other characteristic features will emerge more clearly from the following description of a preferred embodiment, provided by way of a non-limiting example, with reference to the accompanying drawings.

BRIEF DESCRIPTION OF THE DRAWINGS

With reference to FIGS. 1 and 2, an ink-jet print head 10 comprises a base 12 consisting of silicon or other ceramic materials, only part of which is shown in the figures.

Figure 2:
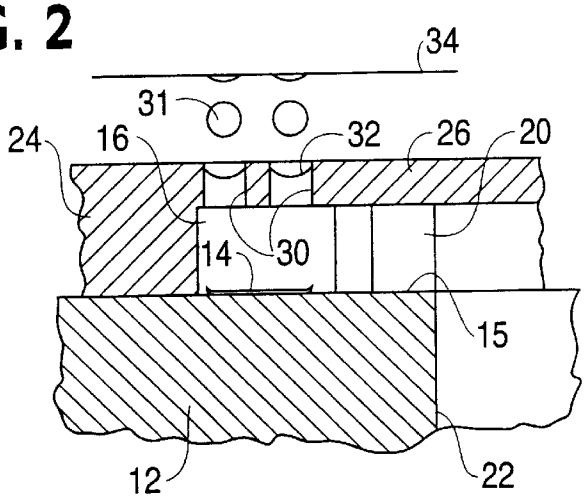
FIG. 2 is a section through FIG. 1, along the lines II—II.

A plurality of pressure generating elements 14, which can be activated selectively for example with voltage pulses, is deposited on the base 12 using a known method.

According to a conventional embodiment, each element 14 consists of a layer of electrically resistive material, for example an Al-Ta alloy.

The elements 14, more usually called resistors, may be arranged aligned in a single or double row "y" with a pitch "p" between two adjacent resistors equal, for example, to $1/150$".

However, the pitch, the arrangement and the form of the resistors may be varied according to requirements.

Each resistive element or resistor 14 is contained in an expulsion chamber or cell 16 with a substantially parallelepiped shape, open only on one side 18 in a direction parallel to the plane 15 of the resistor 14, so as to communicate via an ink supply duct 20 with a collector channel 22 common to all the cells.

For example, in a head designed for a printing resolution of 300 dots per inch, the resistor 14 preferably has a square shape with sides of about 60×60 $\mu$m, while the plan dimensions of the cell 16 are slightly greater than the dimensions of the corresponding resistor 16, i.e. about 70×70 $\mu$m.

The resistors 14 can be composed by a single resistive element, as shown in FIG. 2. or can be composed by two resistive elements 141 and 142, as shown in FIG. 21, closely spaced and electrically connected either in parallel or in series, in order to generate two separate vapour bubbles inside the cell 16, achieving in this way a better matching between the quantity of vapour and the volume of ink inside the nozzles.

It is understood that the dimensions of the cell 16, resistor 14 and pitch "p" may vary considerably depending on the performances which are required of the print head.

The cell 16 and corresponding duct 20 are formed in the thickness of a foil 24 consisting of suitable synthetic materials, as explained below.

Figure 1:
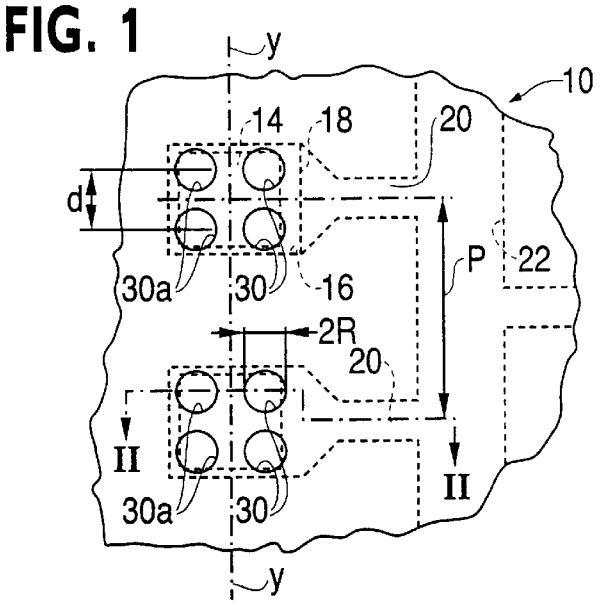
FIG. 1 is a partial view of an improved ink-jet print head embodying to the invention.

The closing wall 26 of the cell opposite the resistive element 14 has formed in it a plurality of nozzles 30, varying in number from three to nine. The preferred non-limiting example of embodiment according to FIG. 1 shows four nozzles arranged at the vertices of a square. The axes of the four nozzles are perpendicular to the plane 15 of the resistor 14.

The construction of the cell 16, the nozzles 30 and the ducts 20 may be effected using one of the known techniques.

According to a first technique which is now established, the cells 16 are formed in a layer of a photopolymer, for example VACREL (Du Pont trade-mark), using the so-called photoetching method, while the nozzles 30 are formed by perforating a thin layer of MYLAR or KAPTON (Du Pont trade-mark), using an excimer laser ray beam shuttered by a suitable mask. The nozzle-bearing layer and photopolymer layer thus processed are arranged on top of one another and both pressed onto the support base 12, without the use of glues since the photopolymer layer is per se self-adhesive.

According to another known technique, the cells 16 and the nozzles 30 are formed in a single foil 24 (FIG. 2) of MYLAR or KAPTON, using an excimer laser ray beam shuttered by means of suitable masks. For example, with a first mask, the laser beams form in the foil 24 in a single operation the cells 16 and the ducts 20, etching only partially into the thickness of the foil 24; then, with a second mask, all the nozzles 30 are formed simultaneously, perforating the wall 26 created during the previous operation. The foil 24 may be cut to the desired length from a strip of the desired width.

After processing of the cells 16, the ducts 20 and the nozzles 30, the foil 24 is pressure-fixed with an adhesive onto the base 12.

In both the previously described techniques, depending on the conditions during the process, the shape of the nozzle 30 can show a different tapering angle if observed in a cross section, i.e. it can have a zero tapering, as shown in FIG. 2, or alternatively a positive or a negative tapering. Also the cross-section of the nozzles 30 can be a circle, as shown in FIG. 1, or can have a different shape, for example a square, a rhombus or an oval.

Finally, according to another known method, the cells 16 and the ducts 20 are formed in a first layer of MYLAR or KAPTON, while the nozzles 30 are separately punched in a different foil consisting of the same materials. Then the layer containing the cells 16 and the ducts 20 and the foil containing the nozzles are glued onto one another and fixed onto the base 12.

Indipendently from the method adopted to form the nozzles 30, they can be formed in such a way as to be totally inside the perimeter of the projection of the cell 16, or they can be partially outside of it.

During operation, the cell 16, the duct 20 and the collector 22 are kept full of ink, which forms a meniscus 32 in the nozzles 30 (FIG. 2).

When at rest, the meniscus 32 remains in hydraulic equilibrium with respect to a negative pressure applied to the collector 22 by ink supply members, not shown, formed for example by a sponge soaked with ink.

The application to the resistor 14 of a voltage pulse, generated by an activation circuit of a known type and not shown in the drawings, causes sudden heating of the resistor 14 and formation of a vapour bubble, the volume increase of which inside the cell 16 expels simultaneously from the four nozzles 30 the same number of drops of ink 31.

The drops of ink 31, before being deposited on a printing medium 34, travel along a short trajectory coaxial with the axis of each nozzle 30 and hence each parallel with one another. Therefore the drops are deposited on the medium 34, situated at a distance of between 0.5 and 2 mm from the nozzles, retaining the same configuration as the nozzles. In the case of four nozzles 30, as shown in FIG. 1, a substantially square impression 36 (FIG. 3) will be printed on the medium 34, consisting of four dots 37 arranged at the vertices.

Extensive experiments have been performed by the inventors in order to define the correct relationship between some geometrical parameter, namely the radius "R" of the nozzles 30 and the distance "d" between their axes, to obtain the best result in terms of print quality.

It is well known to those skilled in the art, that in the ink-jet printing at 300 dots per inch, to print on plain xerographic paper with the state of the art inks, it is required a volume of the single drop ranging from 50 to 250 picoliters, preferably from 100 to 200 pl.

Referring to the preferred non-limiting example of embodiment according to FIG. 1 in which there are 4 nozzles 30 per cell 16, the single emitted drop should have a volume "v" ranging from 12.5 to 62.5 pl, preferably from 25 to 50 pl and each of it will produce on the paper a dot 37 with a diameter "D".

The following equation, experimentally found by the inventors, relates the volume "v" of the drop of ink to the diameter "D" of the dot impressed on the paper:

$$D = K\sqrt[n]{v}$$

where K and n are constants depending on the ink and on the paper.

In particular, with the ink used in the Olivetti printer JP 250 and a good quality xerographic paper, a drop of 25 pl impresses a dot of approximately 42 $\mu$, and a drop of 50 pl impresses a dot of approximately 68 $\mu$.

Figure 3:
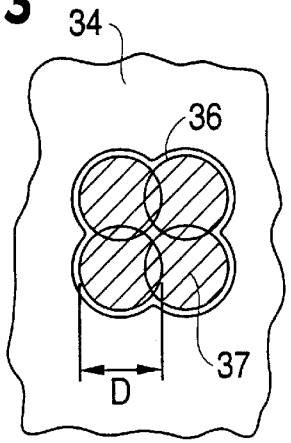
FIG. 3 shows some sample print impressions obtained with the head according to FIG. 1.

Referring to FIG. 3, the 4 dots 37 should be tangent or partially overlapping in order to obtain a good print quality; this is obtained when the distance "d" between the axes of the nozzles 30 is:

$$d \leqq D$$

or better, $0.4\ D<d\leqq D$, preferably $0.5\ D<d<0.9\ D$.

Moreover the drops 31 expelled from the nozzles 30 should not join together during their flight to the paper 34, otherwise would be missed the effect of the "sprayed" distribution that permits to print black areas with the same optical density but with less ink than using a single nozzle.

This result is obtained when, indicating with R the radius of a nozzle 30, the above mentioned distance "d" satisfies the condition:

$$d \geqq 2.0R$$

or, better, $d\geqq 2.2\ R$, preferably $d\geqq 2.5\ R$.

As a result of the use of excimer laser ablation technology, it is easily possible to manufacture ink-jet print heads in which multiple nozzles, for example up to 9 nozzles per cell, can be produced, with the characteristics of diameter and distance between their axes according to the previously mentioned preferred values.

The improvements in print quality obtained with a print head according to the present invention are now illustrated.

Figure 6:
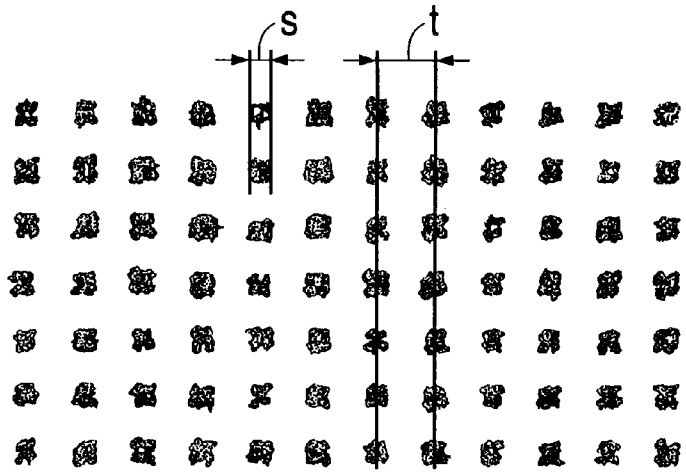
FIGS. 6 and 7 show photographic enlargements of a grid printed with the head according to FIG. 1.

FIG. 6 is a photographic enlargement of a set of dots arranged in an orthogonal grid printed with the four-nozzle head according to FIG. 1, with a pitch "t" equal to about 2.5 times the dimension "S" of a single impression.

Figure 7:
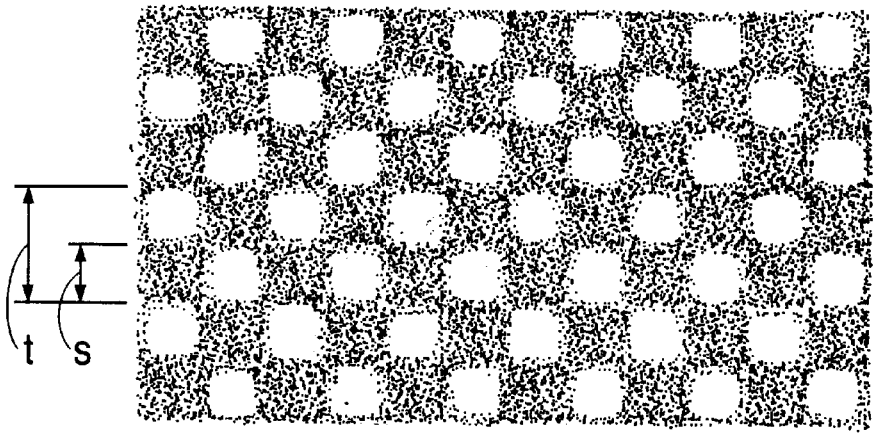

FIG. 7 is a photographic enlargement of a grid similar to that of FIG. 6, but printed with a pitch "t"="2s".

Figure 8:
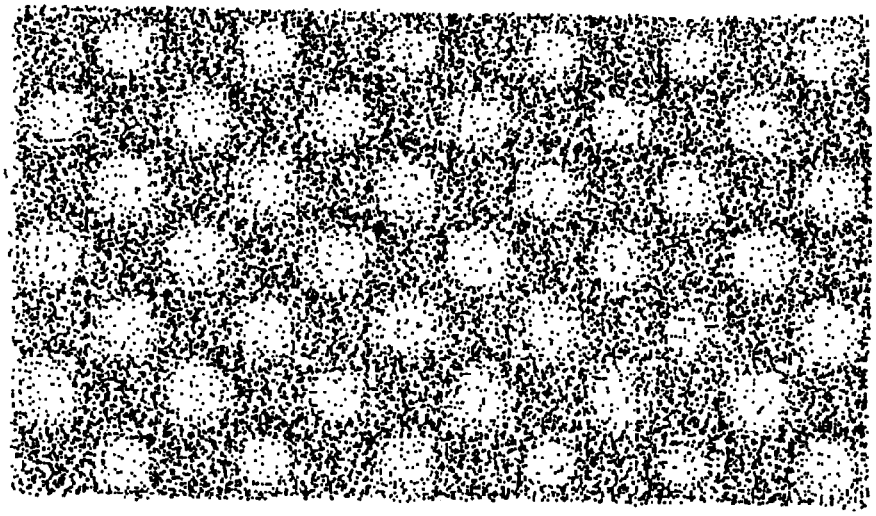
FIGS. 8 and 9 show photographic enlargements of a grid printed with a conventional head.
Figure 9:
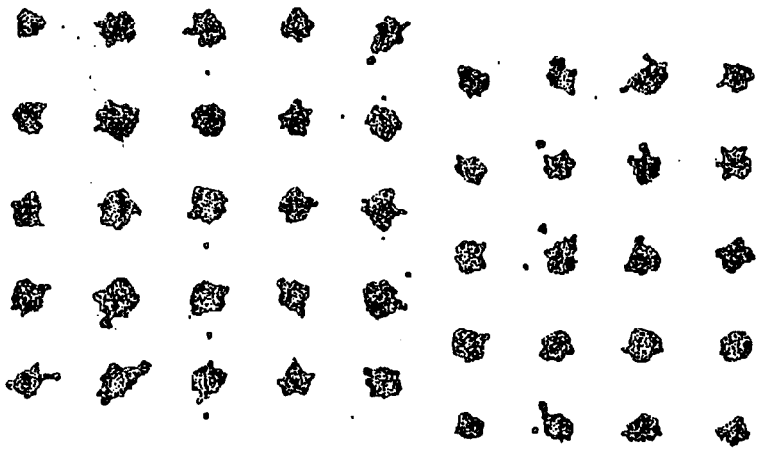

FIGS. 8 and 9 show two sets of dots arranged in grids similar to those of FIGS. 6 and 7 respectively, but printed with a conventional ink-jet head provided with cells having only one nozzle.

A comparison of the printed images in FIGS. 6 and 7 with those of FIGS. 8 and 9 clearly shows that the head 10 of FIG. 1, according to the invention, for example with four nozzles per cell, produces a marked improvement in the print quality of graphic images.

As already stated above, in a preferred embodiment, the nozzles 30 are arranged at the vertices of a square (FIG. 1) with one side parallel to the reference direction "y" of alignment of the cells 16. In other words the nozzles 30 are arranged in an orthogonal grid having one of the axes parallel to the direction "y".

When the head 10 is mounted on a printer, not shown in the drawings, the direction "y" is normally vertical and perpendicular to the direction of movement of the head. However the head may be oriented, on the printer, in different directions with respect to the movement of the head, so that the direction "y" may be inclined with respect to the vertical.

Figure 4:
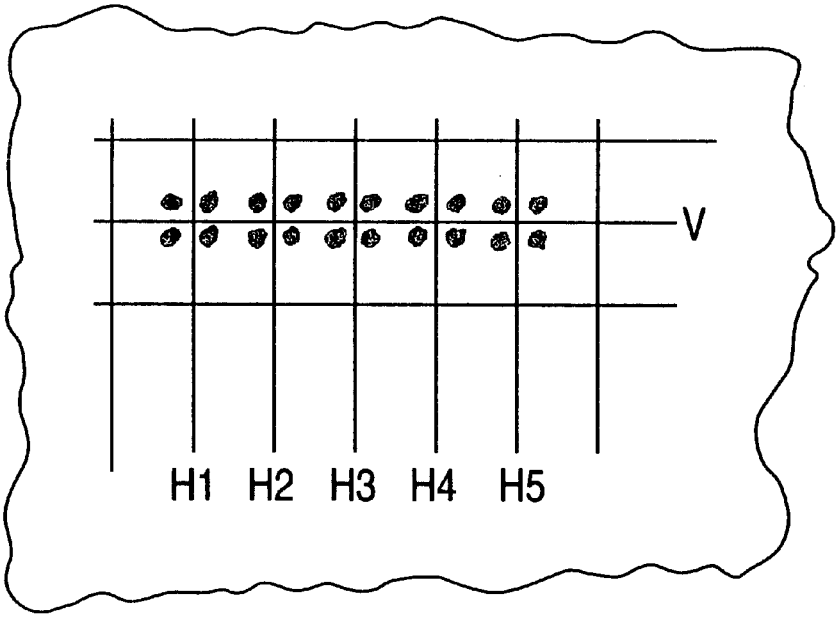
FIGS. 4 and 5 show samples of a horizontal line and vertical line printed with the head according to FIG. 1.
Figure 5:
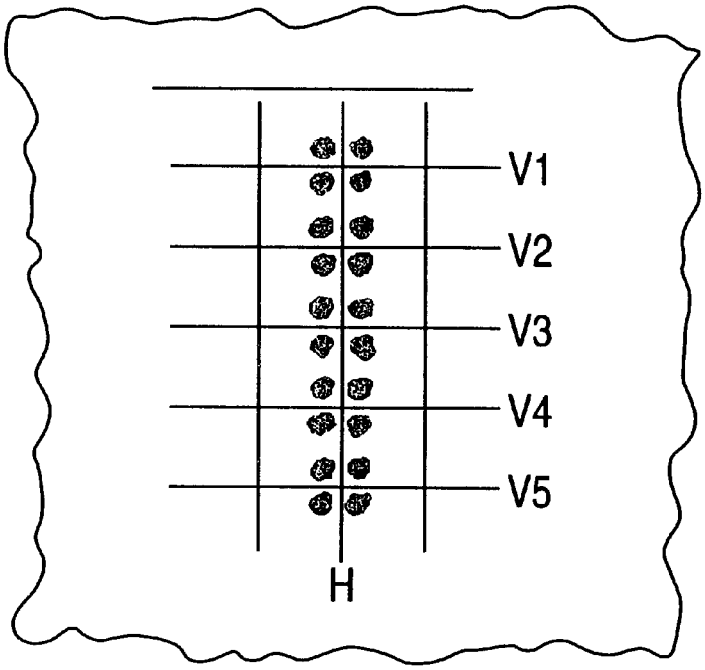

Therefore, by printing in succession groups of four dots 37, which form the impression 36 (FIG. 3), in the printing positions H1, H2, H3, etc. adjacent and aligned in a direction perpendicular to the direction y, a horizontal line is obtained (FIG. 4). Similarly if the groups of dots 37 are printed in the printing positions V1, V2, V3, etc., (FIG. 5) adjacent and aligned in the direction "y", a vertical line parallel to the direction "y" is obtained.

If in each of the printing positions V1, V2, V3, etc., instead of a single group of four dots 37, several groups are arranged next to one another horizontally, a vertical segment with a certain transverse width, such as for example the stem 40 (FIG. 11) of the letters l and T, is printed.

Similarly by associating in each printing position H1, H2, H3, etc., more than one group of dots 37 arranged vertically, a horizontal segment, such as for example the base 49 of the letters l and T, is printed.

Figure 10:
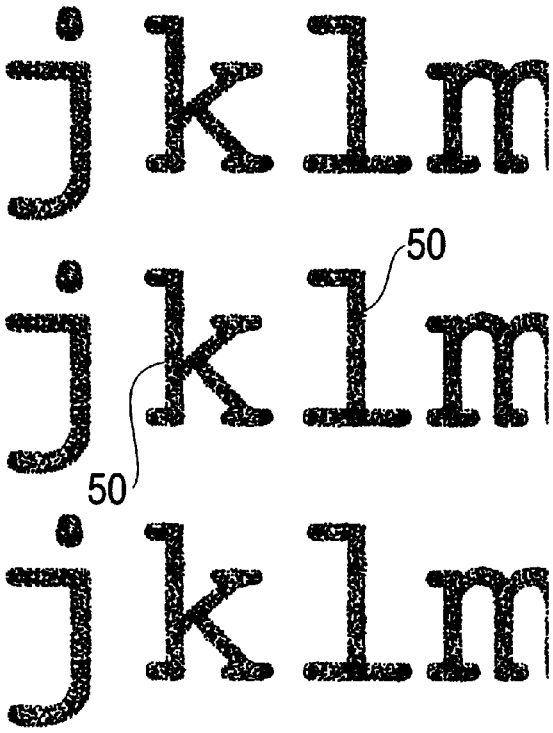
FIGS. 10 and 11 show enlarged characters printed with a head according to FIG. 1.

FIG. 10 shows a photographic enlargement of some characters printed with a four-nozzle head according to the invention. These characters have an edge 50 with a substantially straight profile, as can be seen more clearly in FIG. 11, which is further enlarged.

Figure 11:
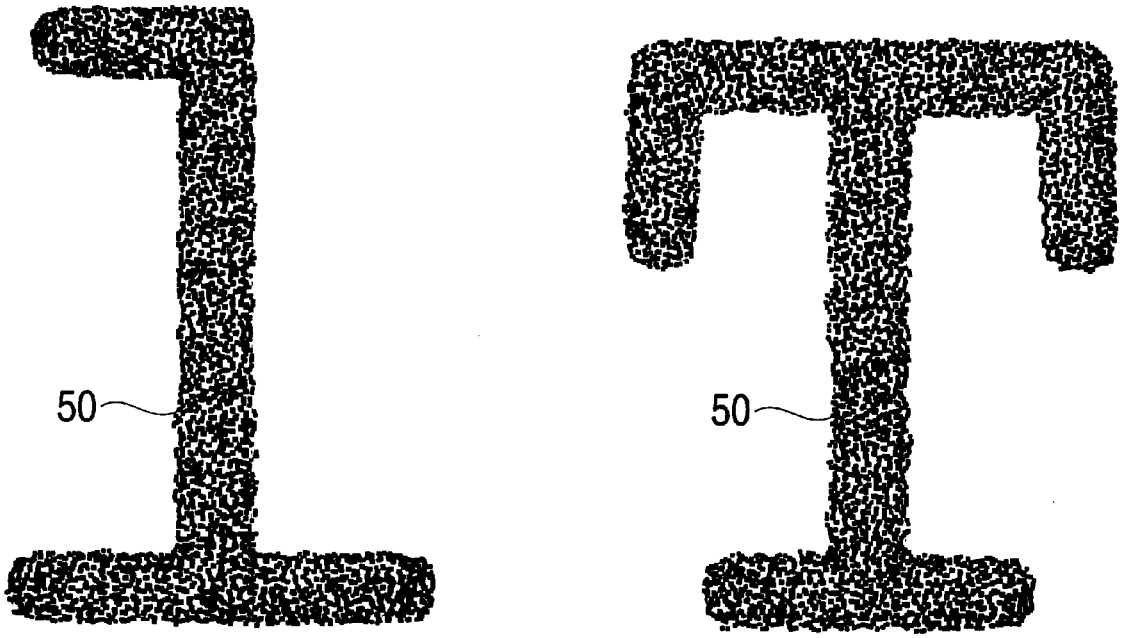
Figure 12:
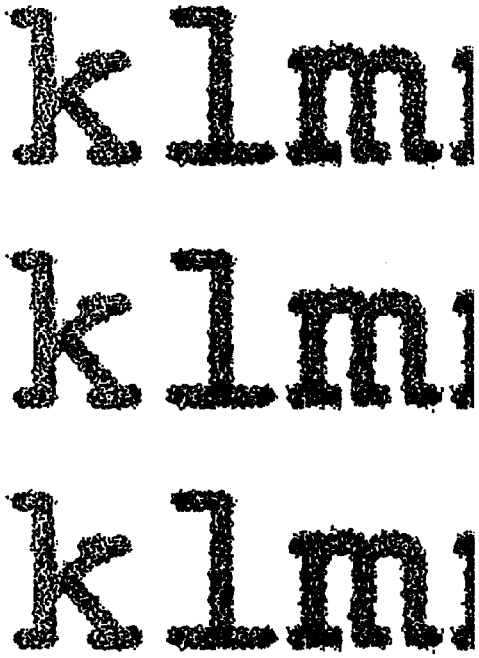
FIGS. 12 and 13 show the same characters printed with a conventional head.
Figure 13:
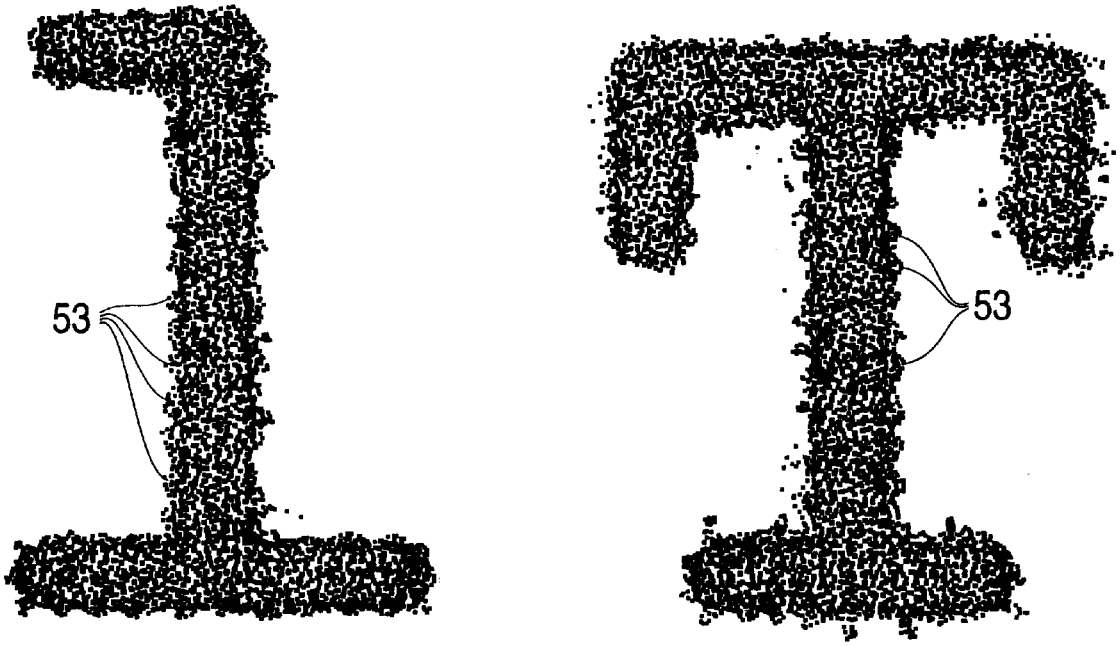

From a comparison of the profile of the edge of the characters of FIGS. 10 and 11 with that of the same characters shown in FIGS. 12 and 13 and printed with a conventional head with one nozzle per cell, it can be seen that the edge of the characters of FIGS. 12 and 13 has an irregular profile formed by a succesion of round profiles 53, corresponding to the impressions of the individual drops of ink emitted by the head with a single nozzle per cell.

Therefore, it is clear that, with an ink-jet print head with four nozzles per cell arranged at the vertices of a square according to the invention, a high print quality for alphanumeric characters is obtained.

As already seen, with the four-nozzle head according to FIGS. 1 and 4 and more generally with a number of nozzles greater than two, for example from three to nine, the printed impression is formed by a plurality of basic dots equal to the number of nozzles which expelled them. On account of the greater surface distribution of the ink on the paper, the numerous and smaller drops dry more rapidly than a single drop of the same volume.

Therefore, using print heads with several nozzles for each expulsion chamber, a reduction in the ink drying time is obtained, without having to alter the composition of the ink itself.

A further advantage obtained by a similar print head, i.e. in which each compression chamber has several nozzles associated with it, is that of obtaining composite impressions or dots with shapes different from a circular shape, as has already been seen in the case of four nozzles.

Therefore, according to the invention, it has been found that it has been possible to obtain impressions with the most convenient shape for printing particular characters, using several nozzles for each compression chamber, arranged in suitable configurations, for example in a flat grid formed by two groups of reference axes not parallel with one another.

Figure 14:
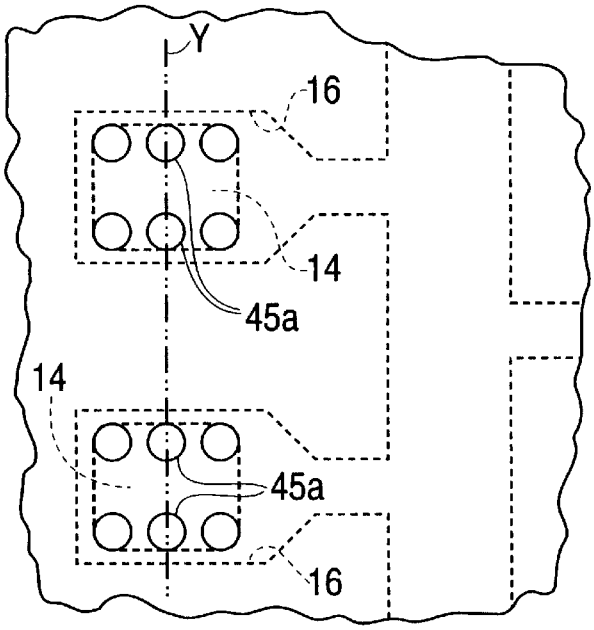
FIGS. 14 and 15 show, respectively, a configuration of a head with six nozzles per cell and a corresponding print sample.
Figure 15:
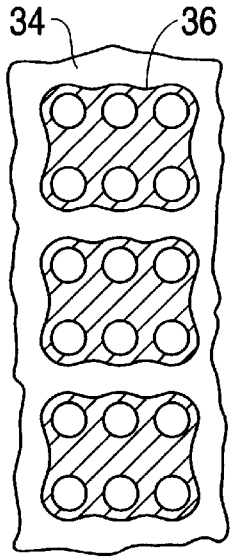

Thus, for example, with nine nozzles arranged in an orthogonal grid in the form of a 3×3 matrix, square impressions similar to those of FIG. 3 are obtained, while with 6 nozzles arranged in two parallel rows of 3, rectangular impressions (FIGS. 14 and 15) of variable dimensions may be printed, depending on the diameter of the nozzles and their distance from one another.

In particular, the impression with a square or rectangular shape is conveniently used for the printing of certain bank documents which use alphanumeric characters with straight contours having right-angled edges, or for the printing of bar characters.

Figure 18:
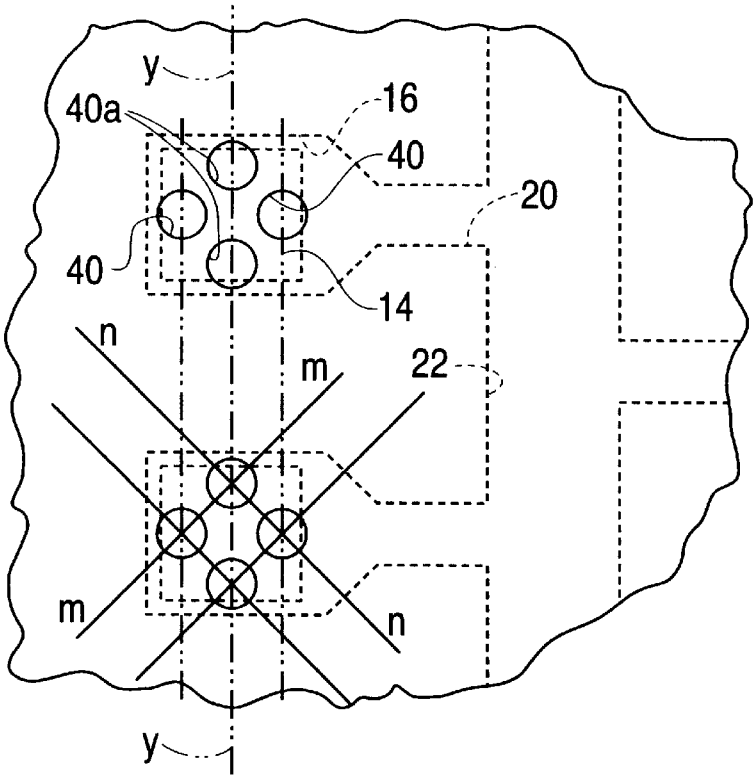
FIG. 18 shows partially a print head with four nozzles per cell arranged at the vertices of a rhombus.
Figure 19:
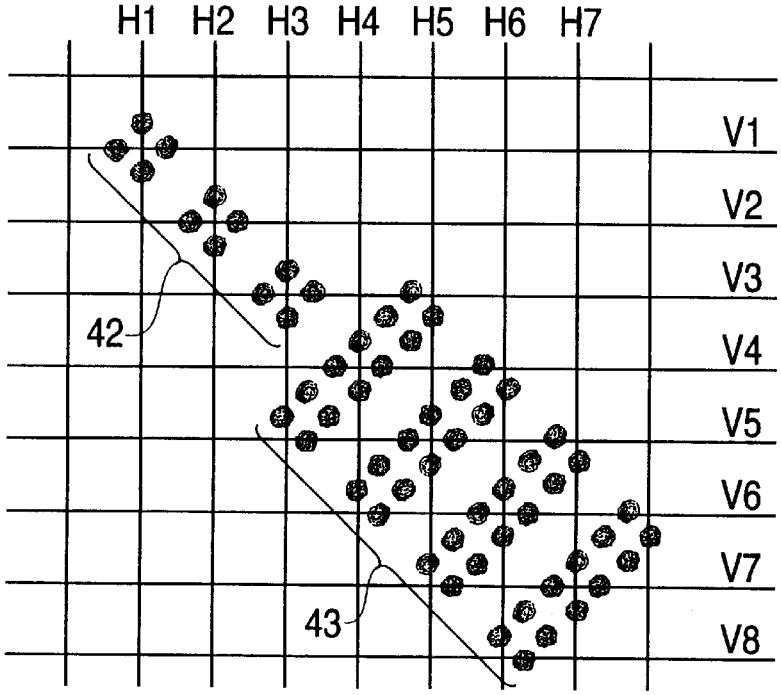
FIG. 19 shows a print sample of an inclined segment obtained with the head according to FIG. 18.

FIG. 18 shows a configuration of four nozzles different from that of FIG. 1.

The four nozzles 40 (FIG. 18) are arranged at the nodes of an orthogonal grid having the axes m—m and n—n inclined by about 450 with respect to the direction "y" of alignment of the cells 16.

With this configuration of nozzles, the groups of dots printed in succession in offset printing positions in the two—vertical and horizontal—directions generate lines and/or segments inclined with respect to the direction y of alignment of the cells 16.

Figure 17:
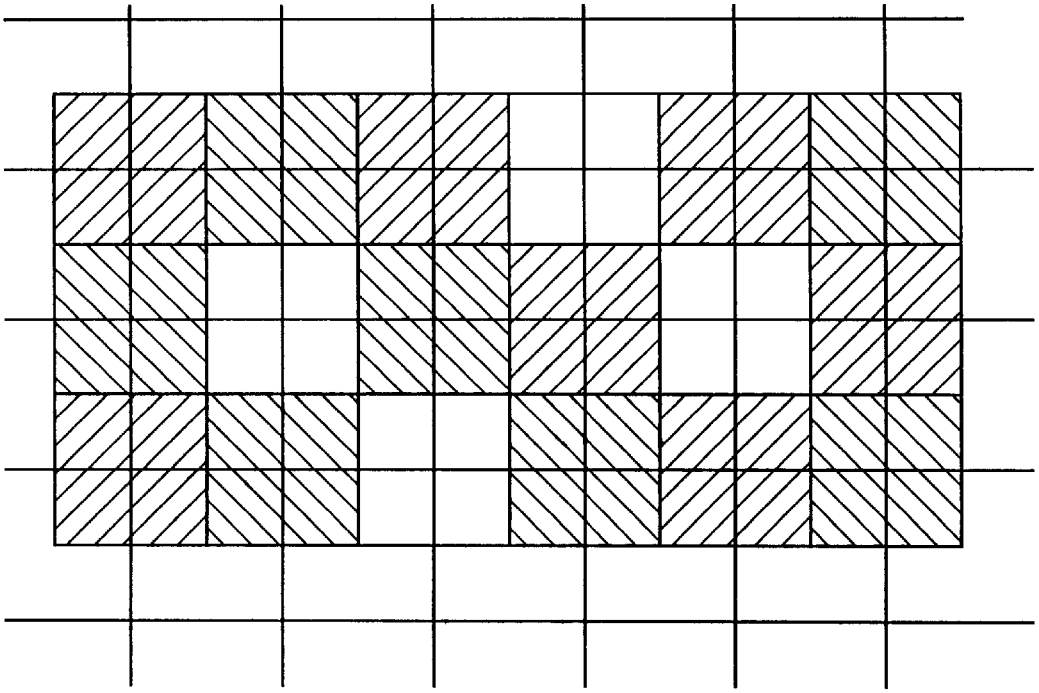

In particular, if the printing positions H and V are equally spaced in the two directions, lines 42 or segments 43 inclined at 45° with respect to the direction y are obtained (FIG. 17).

With this configuration it is possible to print the inclined segments of the letters K, M, N, etc. having straight edges with profiles free from irregularities.

Figure 20:
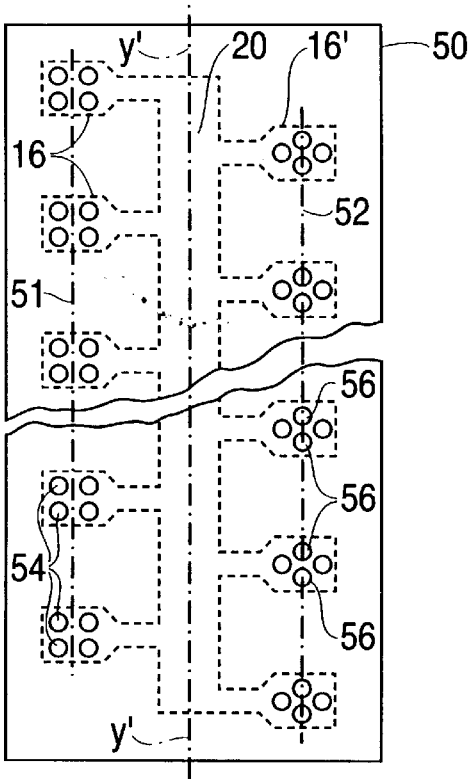
FIG. 20 shows partially a print head embodying to the invention with a double configuration.

FIG. 20 shows a print head 50 in which the cells 16 are aligned in the direction y'—y' in two parallel rows. The cells 16 of a row 51 are offset by half a pitch in the direction "y" with respect to the cells 16' of the parallel row 52. Each cell 16 of the row 51 expels ink through four nozzles 54 in a square configuration with a side parallel to the direction y' of alignment as in FIG. 1.

Each cell 16' of the row 52 expels ink through four nozzles 56 arranged at the vertices of a square with the sides inclined at 45° with respect to the direction y', in a similar manner to the arrangement of FIG. 18.

By activating selectively the cells 16 and/or 16'the head 50 (FIG. 20) prints graphic symbols, such as the letters A, K, M, etc., comprising vertical, horizontal and inclined segments which have edges with straight profiles free from irregularities, thus ensuring an excellent print quality.

Obviously the cells 16 and 16' of the head of FIG. 20 may be arranged also in different ways from that shown. For example, one or more cells 16' of the row 52 may be exchanged with the same number of cells 16 of the row 51.

Observing the arrangement of the nozzles of each cell 16 shown in FIGS. 1, 14, 18 and 20, it can be seen that a pair of nozzles, for example that denoted by 30*a* (FIG. 1), 45*a* (FIG. 14), 40*a* (FIG. 18), 54 and 56 (FIG. 20), is arranged in a row parallel to the reference axis "y", while each additional nozzle or pair of nozzles is arranged laterally offset with respect to the reference direction on one side only or on both sides.

In view of the fact that the restoration time for each meniscus in the group of nozzles is less than for a single nozzle, it can be concluded that a head with a plurality of nozzles for each expulsion chamber is able to operate at a higher speed compared to a head with a single nozzle per cell.

In the case of a head with three and four nozzles per cell, a repetition speed of about 9 KHz has been experimentally obtained.

For the printing of graphic images both in black-and-white and colour, the square configuration of the nozzles enables the quantity of ink deposited on the paper to be reduced considerably, whilst maintaining the same chromatic intensity of the image to be reproduced.

Figure 16:
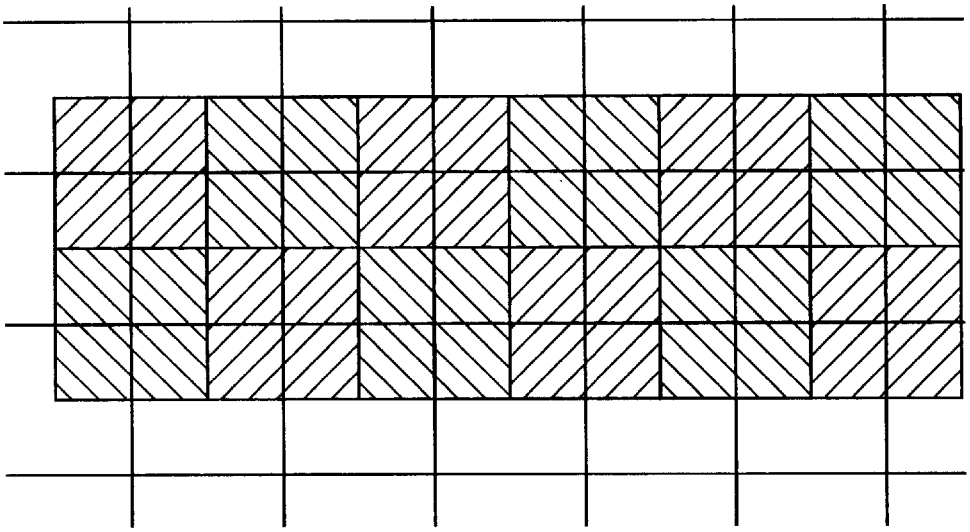
FIGS. 16 and 17 show coverage methods obtained with the head of FIG. 1.

In fact, in order to obtain 100% coverage (FIG. 16), it is no longer necessary to effect superimposition of the printed impressions, as in the case of circular impressions obtained with a single nozzle.

Moreover, the square or rectangular shape of the impression printed with a head having several nozzles per cell, according to the invention, makes it possible to obtain shades of grey, or more generally, chromatic variations which are very regular and repeatable. In fact, the variation in the area covered by ink (FIG. 17) is directly proportional to the number of dots removed during printing.

It is understood that the print head according to the invention may be subject to variants, additions or replacement of parts or variations in shapes without thereby departing from the scope of the invention.

What is claimed is:

1. An ink-jet print head for a dot printer comprising:

an expulsion chamber for expelling droplets of ink, said chamber having a substantially parallepiped shape with side walls, a base wall and a closing wall opposite said base wall;

pressure generating means, deposited on said base wall of said expulsion chamber, for generating a pressure inside said expulsion chamber; driving means for selectively driving said pressure generating means; and a plurality of circular nozzles through which said droplets of ink are expelled, formed on said closing wall and communicating with said expulsion chamber, whereby said pressure generated by said pressure generating means expels simultaneously from said expulsion chamber a corresponding plurality of said droplets of ink, each nozzle of said plurality of circular nozzles having a radius R and a center, said plurality of circular nozzles being disposed according to a geometrical arrangement in which a distance d of the center of a nozzle of said plurality of nozzles with respect to the center of any other nozzle of said plurality of nozzles is not lower than 2.2 times said radius R, wherein said geometrical arrangement comprises a grid having a first reference axis parallel to a reference direction, and a second reference axis orthogonal with said first reference axis.

2. An ink-jet print head according to claim 1, in which said plurality of nozzles comprises four nozzles arranged at vertices of a square.

3. An ink-jet print head according to claim 1, wherein said expulsion chamber and saaid plurality of nozzles are obtained by subjecting a foil of plastic material to excimer laser radiation.

4. An ink-jet print head according to claim 1, wherein said pressure generating means comprises an electrically resistive element.

5. An ink-jet print head according to claim 4, wherein said resistive element comprises two resistors connected in series.

6. An ink-jet print head according to claim 4, wherein said resistive element comprises two resistors connected in parallel.

7. An ink-jet print head according to claim 1 in which said droplets of ink print dots having a diameter D on a printing medium said distance d being lower than said diameter D of said dots, but higher than 0.4 times said diameter D.

8. An ink-jet print head for a dot printer comprising:

a plurality of expulsion chambers for expelling droplets of ink, said chambers having a constant pitch and being aligned in a reference direction, each chamber of said plurality of expulsion chambers having a substantially parallepiped shape with side walls, a base wall and a closing wall opposite said base wall;

pressure generating means, deposited on said base wall of said each chamber for generating a pressure inside said each chamber; driving means for selectively driving said pressure generating means; and a plurality of circular nozzles through which said droplets of ink are expelled, formed on said closing wall and communicating with said each chamber, whereby said pressure generated by said pressure generating means expels simultaneously a corresponding plurality of said ink droplets from said each chamber, each nozzle of said plurality of nozzles having a radius R and a center; said center being disposed in a geometrical position corresponding to a vertex of a polygon;

wherein said plurality of expulsion chambers is alternately arranged in a first row and in a second row parallel to said first row, each chamber of said plurality of expulsion chambers arranged in said first row communicating with a first plurality of nozzles consisting in four nozzles arranged at vertices of a first square having a side parallel to said reference direction; and each chamber of said plurality of expulsion chambers arranged in said second row communicating with a second plurality of nozzles consisting in four nozzles arranged at vertices of a second square having a side inclined at 45° with respect to said reference direction.

9. An ink-jet print head according to claim 8, wherein said chambers of said plurality of expulsion chambers arranged in said first row is offset by half of said pitch in said reference direction with respect to said chambers of said plurality of expulsion chambers in said second row parallel to said first row.

10. An ink-jet print head according to claim 8, wherein a distance between said center of said each nozzle with respect to the center of any other nozzle of said plurality of nozzles is not lower than 2.2 times said radius R.

11. An ink-jet print head according to claim 8, in which said droplets of ink print dots have a diameter D on a printing medium, wherein said center of said each nozzle is arranged by having a distance with respect to the center of any other nozzle of said plurality of nozzles lower than said diameter D of said dots but higher than 0.4 times said diameter D.

* * * * *